United States Patent [19]

Miller

[11] Patent Number: 4,608,113

[45] Date of Patent: Aug. 26, 1986

[54] WATERPROOF QUICK MATCH AND APPARATUS AND METHOD OF FORMING SAME

[76] Inventor: Thomas E. Miller, 600 Center Ave., Grand Junction, Colo. 81501

[21] Appl. No.: 302,169

[22] Filed: Sep. 14, 1981

[51] Int. Cl.[4] ..... B65H 11/08

[52] U.S. Cl. ..... 156/438; 53/547; 53/550; 53/551; 53/553; 86/1.1; 86/20 R; 102/275.1; 102/200; 156/201; 156/467

[58] Field of Search ..... 44/42, 46, 47; 144/50, 144/51; 53/394, 395, 522, 547, 550, 551, 553; 86/1 R, 20 R; 156/438, 467; 102/275.1, 200

[56] References Cited

U.S. PATENT DOCUMENTS

| | | | |
|---|---|---|---|
| 988,247 | 3/1911 | Criswell | 144/51 |
| 1,902,122 | 3/1933 | Gioiosa | 493/297 |
| 2,432,220 | 12/1947 | Weyl | 44/42 |
| 2,607,696 | 8/1952 | Kunz | 53/550 |
| 3,260,201 | 7/1966 | Kelley et al. | 102/275.1 |
| 3,272,604 | 9/1966 | Tigrett et al. | 44/42 |
| 3,367,266 | 2/1968 | Griffith | 102/275.1 |

FOREIGN PATENT DOCUMENTS

| | | | |
|---|---|---|---|
| 0815258 | 6/1959 | United Kingdom | 44/42 |

*Primary Examiner*—William R. Dixon, Jr.
*Assistant Examiner*—Margaret B. Medley
*Attorney, Agent, or Firm*—Limbach, Limbach & Sutton

[57] ABSTRACT

The present invention is an improved waterproof quick match and apparatus and method of making same in which the loose fitting central core (fuse) covering is made of a plastic coated paper and heat sealed at the seams in a waterproof relationship.

9 Claims, 15 Drawing Figures

WATERPROOF QUICK MATCH AND APPARATUS AND METHOD OF FORMING SAME

A quick match is a device used in the pyrotechnic industry for many purposes. The largest use perhaps is in the manufacture of set pieces which are connected together by a quick match and make fire pictures.

Prior to the quick match, a black match core (fuse) burned at a rate of a few seconds per foot. The advent of the quick match allowed the fuse to burn at a rate of 5 to 20 feet per second, thereby allowing for the rapid transfer of fire from one place to another.

For a long time the quick match consisted of a central core (or fuse), made up of one or more strands of twine, coated with a mixture of fuse composition and binder. The covering consisted of a paper tube. The covering was made in short lengths and the fuse was threaded through the tube.

The technology of quick matches advanced and next came the production of waterproof quick matches. U.S. Pat. No. 1,902,122 is an illustration of a waterproof quick match. Although, this match was waterproof, it was not easy to make. This quick match required an adhesive bath and the passage through a drying station.

The present invention is an improved continuous waterproof quick match and apparatus and method for making same that overcomes the problems of making waterproof quick matches in the past.

SUMMARY OF THE INVENTION

The present invention consists of an improved waterproof quick match and an apparatus and method for making same.

The improved continuous waterproof quick match uses a standard type central core (fuse). The core is preferably between $\frac{1}{8}''$ to 3/16" in diameter. The core consists of twine with a thick coating of a fuse chemical mix, held together by a binder such as dextrin.

The waterproof central core covering loosely fits around the fuse and is made of a laminated plastic covered paper strip. The covering of this improved quick match is heat sealed in a plastic to plastic or plastic to paper relationship.

The covering can consist of either the heat sealing of one or two laminated strips. When only one strip is used, the heat sealed seam will be either a lap joint or a radially outward extending seam. When two strips are used, there are two radially outward extending seams. In all cases the sealing takes place at the longitudinal edges of the strips.

The waterproof nature of the quick match covering is derived from the plastic coating on the paper. The heat sealing to form the seams is the melting of the plastic to form a plastic to plastic or plastic to paper seam. The apparatus which heat seals the seams of the improved quick match is configured to heat seal the seams in a quick and easy method to produce a continuous quick match.

The method of making the improved continuous waterproof quick match is easy and simple. The heat sealing method allows for rapid sealing of the covering and production of the continuous quick match.

An object of the invention is to provide an improved continuous waterproof quick match.

Another object of the invention is to provide an improved continuous waterproof quick match having a loose fitting outer covering consisting of plastic covered paper.

A still further object of the invention is to provide an improved quick match covering with heat sealed seams.

Another object of the invention is to provide a method of making an improved continuous waterproof quick match.

DETAILED DESCRIPTION OF THE DRAWINGS

Figure 1:
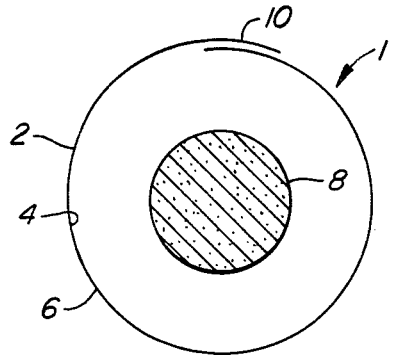
FIG. 1 is a cross-sectional view of the improved continuous waterproof quick match with a heat sealed lap joint.

FIG. 1 shows a cross-section of an improved quick match, generally at 1. The quick match has outer covering 2 and central core (fuse) 8. Central core 8 can be constructed of twine with a thick coating of a fuse mixture with dextrin as a binder. The outer loose fitting covering 2 is laminated and is plastic coated paper.

The covering of FIG. 1 has paper side 6 facing outward and plastic side 4 facing inward. The plastic, in a laminated relationship with the paper, is greater than 1 mil thick. In the preferred embodiment, the plastic used is polyethylene.

Outer covering 2 is a single strip of plastic coated paper, heat sealed in a lap joint at 10. One of the longitudinal edges of the cover is indexed over the other and the plastic of side 4 is heat sealed to paper of side 6. This renders the finished improved continuous quick match waterproof. The method and apparatus used to heat seal the lap joint will be described later.

Figure 2:
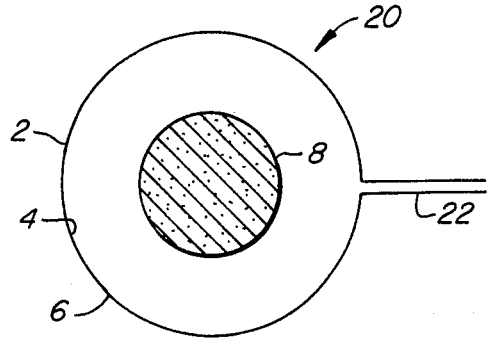
FIG. 2 is a cross-sectional view of the improved continuous waterproof quick match with a single radially outward extending heat sealed seam.

FIG. 2 is a second embodiment of the continuous improved waterproof quick match and is generally shown at 20. Central core (fuse) 8 and outer covering 2 are the same as described for FIG. 1. The difference in FIG. 1 and FIG. 2 is the heat sealed seam. In FIG. 2, the two longitudinal edges of single strip 2 of plastic coated paper are heat sealed in a waterproof radially outward extending seam 22. Surfaces 4 of each of the longitudinal edges are joined and heat sealed forming a plastic to plastic waterproof seam.

Figure 3:
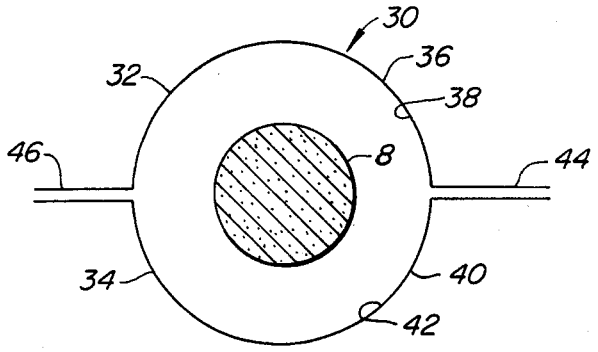
FIG. 3 is a cross-sectional view of the improved continuous waterproof quick match with two radially outward extending heat sealed seams.

FIG. 3 is a third embodiment of the improved continuous waterproof quick match and is generally shown at 30. The embodiment uses two strips 32 and 34 of the plastic covered paper. Plastic surfaces 38 and 42 of the laminated strips face toward the interior of the quick match, while paper surfaces 36 and 40 face away from the interior of the quick match. The two strips 32 and 34 are heat sealed at seams 44 and 46 on diametrically opposed sides of quick match 30. The heat sealing takes place at the longitudinal edges of the two strips. Plastic surface 38 at the longitudinal edges of strip 32 are heat sealed to plastic surface 42 at the longitudinal edge of strip 34. The two strips are heat sealed in a plastic to plastic relationship and form waterproof seams.

Figure 11:
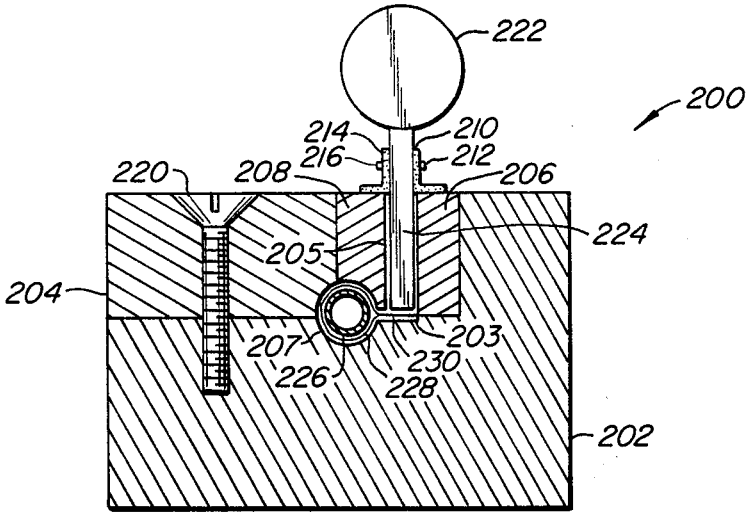
FIG. 11 is a cross-sectional view of the apparatus for forming an improved continuous waterproof quick match with a single radially outward extending seam.
Figure 12:
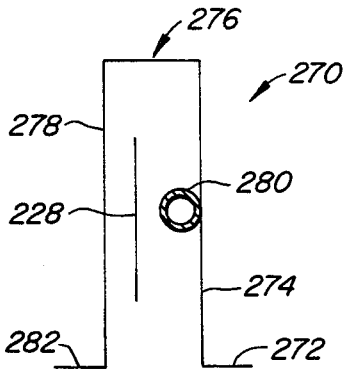
FIG. 12 is a view of the first guide means for making an improved continuous waterproof quick match with a single radially outward extending seam.
Figure 13:
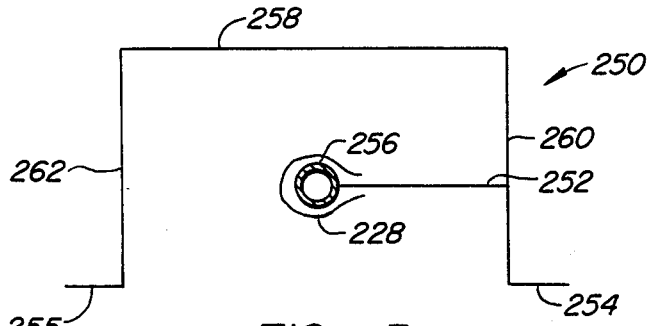
FIG. 13 is a view of the fuse core tube hanger for making an improved continuous waterproof quick match with a single radially outward extending seam.
Figure 14:
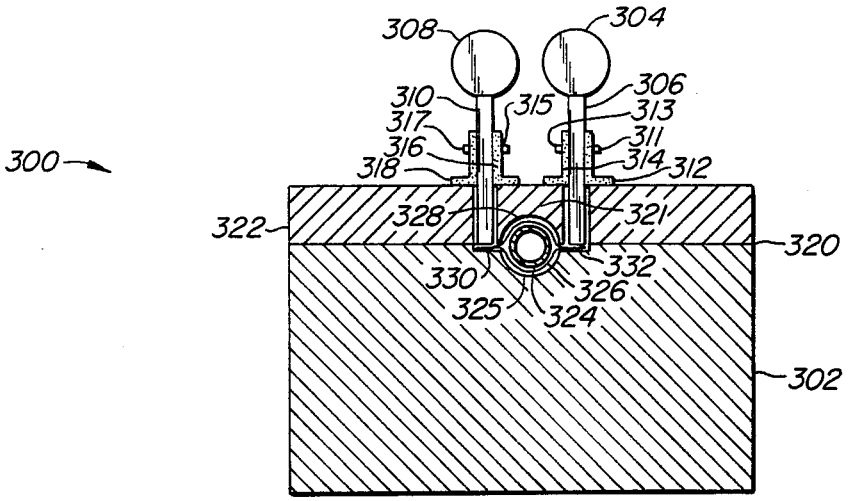
FIG. 14 is a cross-sectional view of the apparatus for forming an improved continuous waterproof quick match having two radially outward extending seams.
Figure 15:
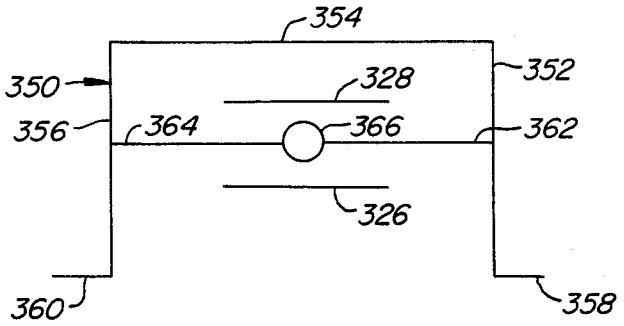
FIG. 15 is a view of the fuse core tube hanger for forming an improved continuous waterproof quick match having two radially outward extending seams.

The apparatuses for making the different embodiments of the improved continuous quick match are shown in FIGS. 4–9 for the quick match with a lap joint; in FIGS. 11–13 for the quick match with a single radially extending seam; and in FIGS. 14 and 15 for the quick match with two radially extending seams.

The apparatus for making the improved continuous waterproof quick match is shown in FIGS. 4 through 9.

Figure 6:
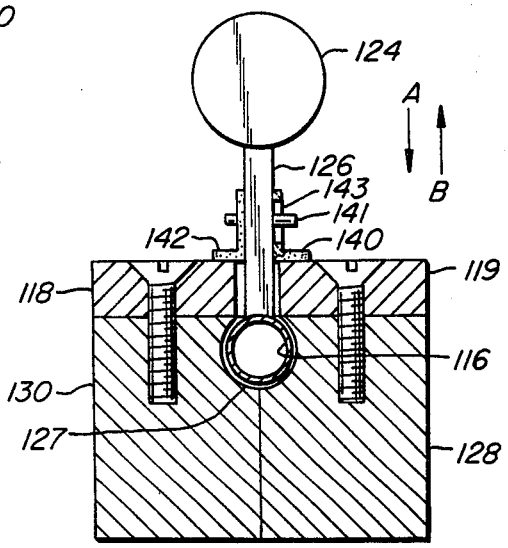
FIG. 6 is a view of FIG. 5 at 6—6.
Figure 4:
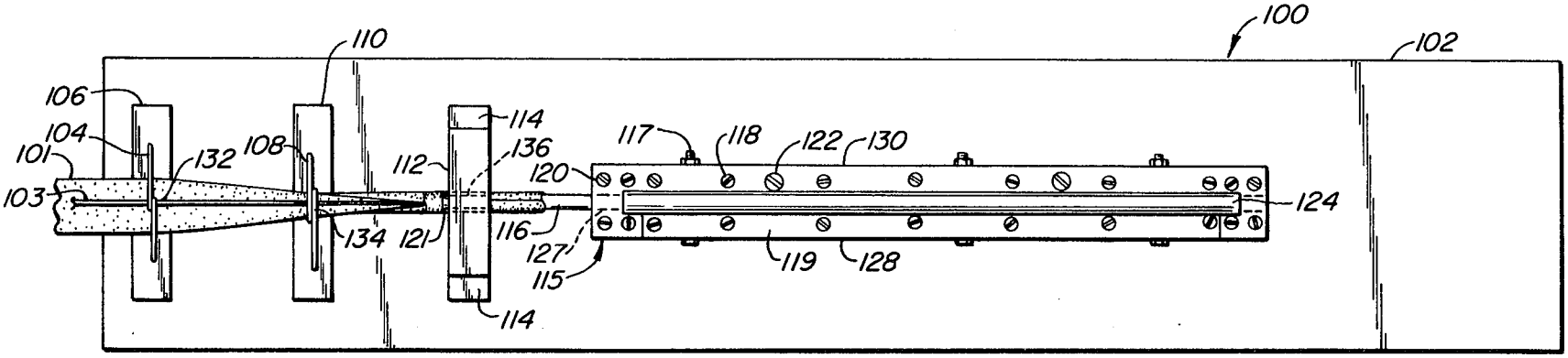
FIG. 4 is a top view of the apparatus to make an improved continuous waterproof quick match having a lap joint.
Figure 5:
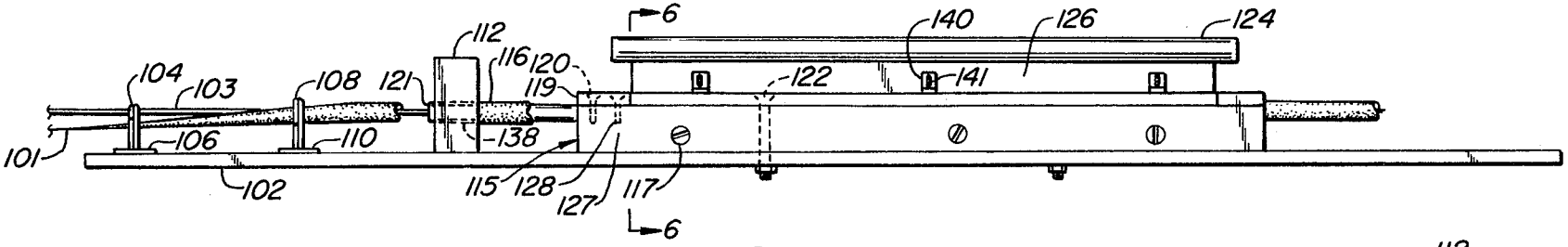
FIG. 5 is a side view of the apparatus to make an improved continuous waterproof quick match having a lap joint.

Referring to FIGS. 4, 5 and 6, different aspect views of the quick match forming apparatus are shown. The apparatus is mounted on bed plate 102. At a first end of bed plate 102 and spaced closely to that end, is the first guide means 104 which has connected thereto plate 106 which is attached by appropriate means to bed plate 102. The first guide means is also shown in full view in FIG. 7.

Spaced away from the first guide means 104 is a second guide means 108. Guide means 108 has connected thereto plate 110 which is attached by appropriate means to bed plate 102. The second guide means is shown in full view in FIG. 8.

Spaced apart from the second guide means 108 farther from the first end is fuse core tube hanger 112. The hanger is constructed from a substantially flat material and is connected by appropriate means to bed plate 102 at tabs 114. Hanger 112 has a downwardly extending vertical member 136 which has disposed, at the end, holder 138 that is designed to hold and support fuse core tube 116. Holder 138 is of the same length as the flat material 112.

Spaced away from hanger 112 and farther from the first end is heat sealing unit 115. The heat sealing unit is a unit of a sufficient length to effect proper heat sealing of the longitudinal edges of the strips used for the fuse covering. The heat sealing unit applies its gravitational weight to the seams and it is this weight and the heat for a sufficient amount of time to properly provide a waterproof seal.

In FIGS. 4, 5 and 6 heat sealing portion 115 has two long blocks 128 and 130. In the preferred embodiment, the blocks are made of aluminum. The two blocks 128 and 130 are cut, milled or the like, so when connected together by screws 117, they provide a recess bore 127 that extends the length of the blocks. Recess bore 127 has a diameter slightly greater than that of fuse core tube 116. There is an open upper portion of the recess bore which spaces apart the upper interior edges of blocks 128 and 130. Recess bore 127 is designed to be concentric with fuse core tube 116 and not to support the tube. Fuse core tube 116 has a flared end 121 and tube 116 slides easily into holder 138 and recess bore 127. When the tube is fully disposed, flared end 121 is against holder 138 and the flared end acts as a stop. Also, when the tube is so disposed it extends the length of recess bore 127.

Disposed on the upper surface of blocks 128 and 130 are block covers 118 and 119. Block covers 118 and 119 are attached to the respective blocks 130 and 128 by screws 120. In the preferred embodiment, the block covers are made of Teflon. However, other materials can be used as long as they are not good heat conductors and do not have a low combustion point.

As previously stated, the upper interior edges of blocks 128 and 130 are spaced apart due to opening in the top of recess bore 127. Block covers 118 and 119 on top of the blocks are spaced apart also, and there is groove which extends longitudinally the length of heat sealing unit 115. Disposed in the longitudinal groove is the heating apparatus consisting of the thermostatically controlled heater 124 and connected thereto heat sealing bar 126. The heat sealing bar extends down into the longitudinal groove. Heater 124 and heat sealing bar 126 are kept in position by pins 141 attached to the heat sealing bar disposed in guides 140 and 142 (FIGS. 5, 6 and 10) which are disposed on opposing sides at intervals along the length of the heat sealing bar. Blocks 128 and 130 with coverings 118 and 119 disposed on the upper surface and heater 124 and heating bar 126 are secured to bed plate 100 by screws 122.

Figure 10:
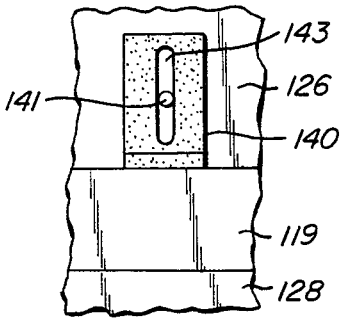
FIG. 10 is a view of the L-shaped guides which maintain the heating unit and heat sealing bar in position.

As can be better seen in FIG. 10, the guides 140 or 142 have a vertical guide slot 143 which acts as a guide for pins 141 attached to the sides of the heat sealing bar 126. The guides are constructed of any appropriate material and fixed to the covers 118 and 119. The pins attached to the heat sealing bar are disposed in the guide slots 143 of the guides. The guides and pins prevent any longitudinal movement of the entire heating sealing portion consisting of the heat sealing bar and the heating unit. The vertical guide slots allow vertical movement of the heating apparatus. The movement range is such that the lower end of the heat sealing bar, remote from the heating unit, rests on the fuse core tube 116. It is the gravitational weight of the heat sealing bar and heating unit which provides the necessary pressure to properly heat seal the cover as the overlapping edges of the strip are passed between the heat sealing bar and the fuse core tube.

Referring to FIG. 6, a cross-sectional view of the heat sealing portion is shown. The description of blocks 128 and 130, covers 118 and 119, recess bore 127, tube 116, guides 140 and 142, heat sealing bar 126 and the thermostatically controlled heater unit 124 have been set forth in the foregoing.

Figure 7:
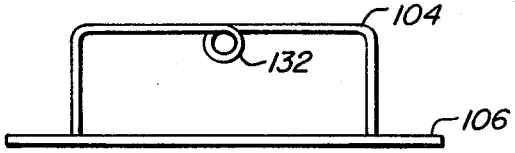
FIG. 7 is a view of the first guide means of the improved continuous waterproof quick match making apparatus where the quick match has a lap joint.

Referring to FIG. 7, the first guide means 104 is shown. The guide consists of upper wire member having loop 132 which has attached thereto mounting plate 106. The main purpose of the first guide means is to support the fuse core as it passes into apparatus 100. The strip used to make the quick match covering passes, plastic surface up, through the open area of first guide means 104 below loop 132. This area is defined by the upper member of guide 104 and plate 106.

Figure 8:
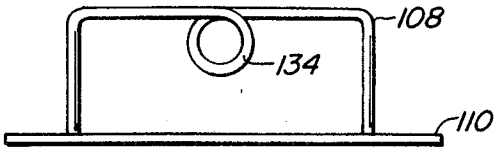
FIG. 8 is a view of the second guide means of the improved continuous waterproof quick match making apparatus where the quick match has a lap joint.

Referring to FIG. 8, the second guide means 108 is shown. The second guide means consists of an upper wire member having loop 134 and mounting plate 110. The purpose of the second guide means is to support the fuse core and to support and curl the flat strip. The curling consists of turning the longitudinal edges of the strip upwards forming a "U". At this point, the fuse core is disposed in the center of the "U".

Figure 9:
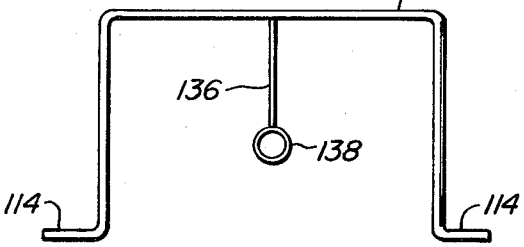
FIG. 9 is a view of the fuse core tube hanger of the improved continuous waterproof quick match making apparatus where the quick match has a lap joint.

Referring to FIG. 9, fuse core tube hanger 112 is shown. The hanger is made of a substantially flat material and has mounting tabs 114 disposed on either side. In the preferred embodiment, the hanger and section 136 are constructed from a brass strip. The tube holder 138 is of a length sufficient to support fuse core tube 116 independently and is also constructed of brass. The tube can be readily inserted and removed from holder 138 and flare end 121 of tube 116 provides a stop means when the tube is slid into holder 138.

When it is desired to form a continuous waterproof quick match as shown in FIG. 1, the following method is used. Strip 101 is fed through the open area of the first guide means 104. Simultaneously, fuse core 103 is fed through and supported by loop 132 of the first guide means. Strip 101 is next fed through loop 134 of the second guide means 108. The second guide means supports and curls strip 101 into a "U" shape. Fuse core 103 is fed through loop 134 of the second guide means simultaneously with the strip. The fuse core is disposed in the center of the curled "U" shaped strip while in loop 134.

Strip 101 is now fed to fuse core tube hanger 112. Strip 101 passes around the exterior of fuse core tube 116. Fuse core 103 is fed and passes to the interior of fuse core tube 116 where it will remain until it exits the apparatus at the other end of heat sealing portion 115.

Since recess bore 127 is concentric with fuse core tube 116 disposed therein, there is small space between the outside diameter of the tube and the inside diameter of the recess bore. The space is of sufficient size to allow the strip to be fed through the space. However, when the strip is fed into the space, the strip is of a size that will cause the longitudinal edges of the strip to overlap when confined in the space between the O.D. of the tube and the I.D. of the recess bore.

The overlapping longitudinal edges of the strip pass under heat sealing bar 126 which rides on to the overlapping longitudinal edges. The heat sealing bar is of a temperature less than 200° C. which is sufficient to heat seal strip 101 into a waterproof quick match cover to surround fuse core 103. Even though generally a temperature of 440° C. is needed to ignite the fuse core and 200° C. is sufficiently below that, the invention uses the fuse core tube to ensure the fuse core does not come in contact with heat sealing bar 126.

The overlapping longitudinal edges are heat sealing into a lap joint during the whole travel in recess bore 127. The lap joint is a plastic to paper seal and the continuous waterproof quick match emerges from a second end of the apparatus requiring only to be cut to the desired length for use.

The cover and fuse core 103 are drawn through the apparatus at the same velocity by traction.

In order to form a second embodiment of the invention, as shown in FIG. 2, the following apparatus and method will be used.

Referring to FIGS. 11–14, elements of the apparatus that are different from those for producing a fuse core with a lap joint are shown. The apparatus, in this case, is designed to produce a fuse core cover with a single radially outward extending seam. These elements are positioned in the same general place as previously described for the apparatus for producing a quick match cover having a lap joint seam.

The cross-section of the apparatus is generally shown at 200. The blocks consist of members 202 and 204. The blocks are preferably made of aluminum. Block 204 is connected to block 202 by screws 220. When blocks 202 and 204 are attached, there is a longitudinal rectangular groove the length of the blocks. Disposed on the sides of the longitudinal groove are covering members 206 and 208. The members 206 and 208, like members 118 and 119, are preferably made of Teflon, however, a material with properties similar to Teflon can be used.

When blocks 202 and 204, with coverings 206 and 208, respectively, are joined, there will be a vertical slot 205 and bore 207 formed. The bore 207 is formed by portions of block 204, covering 208 and block 202 being cut or milled longitudinally to form the bore when they are joined. The vertical slot is formed between the two coverings 206 and 208 when the blocks 202 and 204 are joined. The slot 205 will receive the heat sealing bar 224 with the attached heating unit 222. There is a small passage 203 which communicates the bore 207 and bottom of slot 205. This passage will allow the longitudinal ends 230 of the plastic coated paper 228 to extend into the bottom of slot 205 so the ends can be heat sealed forming the waterproof quick match cover with a radially outward extending seam.

The heat sealing bar 224 with the attached heat sealing unit 222 is kept in slot 205 by guide members 210 and 214 which are fixed to coverings 206 and 208, respectively. Each of the guide members have a vertical slot (as shown in FIG. 10) in which pins 212 and 216 are disposed and guided. The guides will allow vertical but not longitudinal movement of the heat sealing bar 224 with the attached heating unit 222. The pins are positioned such that the full gravitational weight of the bar and unit can come to bear on the longitudinal ends of the plastic coated paper to provide the pressure necessary for heat sealing the ends as they pass under the heat sealing bar.

Referring to FIG. 12, the first guide means for the apparatus for forming a quick match cover shown in FIG. 2 is shown at 270. The first guide means is preferably made of wire and consists of bed plate attachment members 272 and 282, sides 274 and 278, and top 276. There is a loop 280 disposed on side 274 to guide the fuse core (not shown) as it enters the apparatus. The loop 280 can be disposed on either side 274 and 278 depending on which side of the bore 207 the heat sealing bar is positioned. The paper 228 passes vertically through the central portion of the first guide means 270 independent of the loop 280 guiding the fuse core with the plastic side facing the loop.

Referring to FIG. 13, the fuse core tube hanger for forming quick match covers for a quick match, shown in FIG. 2, is generally shown at 250. The fuse core tube hanger is made of a flat strip of material. The strip is bent to form the hanger having tabs 254 and 255 which attach to the bed plate, sides 260 and 262 and top 258.

Disposed from side 260 is the horizontally extending member 252 which has at the end holder 256 that is designed to hold and support fuse core tube 116 (not shown). The holder is of the same length as the flat material comprising hanger 250.

The plastic coated paper 228 forms a "U" around the exterior of the fuse core tube holder 256 and the fuse core tube 226 (FIG. 11) disposed in the holder 256. The longitudinal ends of the paper 228 of the plastic coated paper extend on opposite sides of the horizontally extending member 252. The fuse core itself will pass into the fuse core tube 226 (FIG. 11) held by fuse core tube hanger 256. The fuse core tube 226 will extend in and through the bore 207 (FIG. 11) which is concentric with the tube 226, to allow for the passage of plastic coated paper which will form the quick match cover.

The finished quick match will emerge from the end of the heat sealing portion with a single radially outward extending seam.

Referring to FIGS. 14 and 15, elements of the apparatus that are used to produce a fuse core, as shown in FIG. 3, are shown. A cross-sectional view of the heating sealing portion of the apparatus is shown generally at 300. This apparatus is designed to produce a fuse core covering having two radially outward extending seams and uses two strips of plastic coated paper to produce same.

The heating sealing portion of the apparatus is constructed from block 302, preferably made of aluminum, with cover elements 320 and 322 spaced away from each other but attached to an upper surface of the block 302. A third piece of cover 321 is placed between the previously indicated cover elements 320 and 322, but spaced away such that there is a vertical slot between the third cover element 321 and cover 320 and there is also one between element 321 and cover 322. The cover element 321 is supported on each end of the heat sealing portion (not shown) by any appropriate means.

The block 302 and cover element 321 are cut, milled or the like to form a longitudinal bore 325 which extends the entire length of the block when they are joined together.

Disposed in the slots, formed between the cover elements 320 and 321, and 321 and 322, are the heat sealing bars 306 and 310, respectively. The heat sealing bars 306 and 310 have heating units 304 and 308 attached, respectively. The heat sealing bars maintain their longitudinal position by guides 312 and 314 (for heat sealing bar 306), and 316 and 318 (for heat sealing bar 310). The guides have vertical slots (143) as seen in FIG. 10. Pins 311 and 313 are attached to heat sealing bar 306 and disposed in the vertical slots of guide members 312 and 314, respectively. Pins 315 and 317 are attached to heat sealing bar 310 and are in the vertical slots of guide members 316 and 318, respectively.

The heat sealing bars can move vertically. The bars are so positioned that the entire gravitational weight of the heat sealing bar and heating unit can come to bear at 330 and 332 the bottom of the slots between the cover members 320, 321 and 322 to provide the necessary pressure to heat seal the longitudinal ends of the two plastic covered paper strips 326 and 328. The remainder of the strips 326 and 328 are disposed around the fuse core tabs 324 during the heat sealing process. After passing the two strips beneath the heat sealing bars, a quick match cover with two radially outward extending waterproof seams emerges from the opposite end of the apparatus.

Referring to FIG. 15, the fuse core tube hanger is shown generally at 350 for the apparatus to form a quick match as shown in FIG. 3. The hanger 350 is constructed from a flat strip of material. The hanger has tabs 358 and 360 for attachment to the bed plate, sides 352 and 356 and top 354. Disposed between sides 352 and 356 are horizontal members 362 and 364 which support the fuse core tube support 366. The strips 326 and 328 pass through the fuse core tube hanger horizontally with the plastic sides of the plastic coated paper toward the fuse core tube support 366 and proceed to the heat sealing portion 300 as shown in FIG. 14.

The inventor contemplates the invention to be all that is shown, described and claimed to be the invention in the foregoing and all equivalents thereto.

I claim:

1. A superior quick match forming apparatus comprising:

a bed plate;

a first guide means with means connected to the bed plate and having means to support a continuous flexible elongated member;

a second guide means spaced away from the first guide with means connected to the bed plate having means to support a continuous flexible elongated member and means to support and curl a first and second longitudinal edge of a substantially flat continuous strip member toward each other;

an elongated member passage tube;

an elongated member passage tube hanging means further spaced away from the first guide means having means to suspend an end of the elongated member passage tube;

a strip member heat sealing means and elongated member passage tube means further comprising a pair of elongated block with means connected having a longitudinal recess bore concentric to the elongated member passage tube extending therethrough, surface covering members spaced apart and disposed on an upper surface of each of the respective blocks with means connected to the respective blocks, a vertically movable heat sealing means disposed between the surface covering members and extending into the recess bore of the blocks and removably contacting the elongated member passage tube and a heating unit with means connected to the heat sealing means.

2. A superior quick match forming apparatus comprising:

a bed plate;

a first guide means with means connected to the bed plate;

an elongated member passage tube;

an elongated member passage tube hanging means with means connected to the bed plate and having means to suspend an end of an elongated member passage tube;

a strip member heat sealing means and elongated member passage tube means further comprising a plurality of elongated blocks with means connected having surface coverings and having a longitudinal recess bore concentric to the elongated member passage tube extending therethrough, the surface covering members disposed on a surface of each of the respective blocks, heat sealing means disposed in a slot between the surface covering members, a vertically movable heat sealing means having a heating unit attached thereto and the heat sealing means removably contacting a base of the slot and the base of the slot is adapted to receive longitudinal edges of a strip member.

3. A superior quick match forming apparatus comprising:

a bed plate;

an elongated member passage tube;

an elongated member passage tube hanging means with means connected to the bed plate and having means to suspend an end of an elongated member passage tube;

a strip member heat sealing means and elongated member passage tube means further comprising an elongated block having spaced apart first, second and third surface covering members on an upper surface and forming a recess bore between the block and at least one surface covering member, a plurality of vertically movable heat sealing means with heating unit attached thereon disposed in slots between the surface coverings members, and each heat sealing means removably contacting a base of the slot and the base of the slot is adapted to receive longitudinal edges of a strip members.

4. The apparatus, as recited in claims 1, 2, or 3, wherein the elongated blocks are aluminum.

5. The apparatus, as recited in claims 1, 2, or 3, wherein the elongated member passage tube is aluminum.

6. The apparatus, as recited in claims 1, 2, or 3, wherein the surface covering members are Teflon.

7. The apparatus, as recited in claims 1, 2, or 3, wherein the heating sealing means is an elongated heating bar.

8. The apparatus, as recited in claims 1, 2, or 3, wherein the heating unit is a thermostatically controlled heating unit.

9. The apparatus, as recited in claims 1, 2, or 3, wherein the elongated member is a fuse core.

* * * * *